US006037903A

United States Patent [19]

Lange et al.

[11] Patent Number: 6,037,903

[45] Date of Patent: Mar. 14, 2000

[54] SLOT-COUPLED ARRAY ANTENNA STRUCTURES

[75] Inventors: Mark J. Lange, Camarillo; Andrew H. Burton, Newbury Park, both of Calif.

[73] Assignee: California Amplifier, Inc., Camarillo, Calif.

[21] Appl. No.: 09/196,331

[22] Filed: Nov. 19, 1998

Related U.S. Application Data

[60] Provisional application No. 60/095,398, Aug. 5, 1998.

[51] Int. Cl.[7] ..... H01Q 1/38

[52] U.S. Cl. ..... 343/700 MS; 343/872; 343/906

[58] Field of Search ..... 343/700 MS, 702, 343/846, 848, 872, 906; 333/24 C

[56] References Cited

U.S. PATENT DOCUMENTS

| | | | |
|---|---|---|---|
| 4,816,835 | 3/1989 | Abiko et al. | 343/700 MS |
| 4,903,033 | 2/1990 | Tsao et al. | 343/700 MS |
| 5,001,492 | 3/1991 | Shapiro et al. | 343/700 MS |
| 5,241,321 | 8/1993 | Tsao | 343/700 MS |
| 5,661,494 | 8/1997 | Bondyopadhyay | 343/700 MS |

OTHER PUBLICATIONS

Zurcher, Jean–Francois, et al., *Broadband Patch Antennas*, Artech House, Boston, 1995, pp. 45–61.

Pozar, David M., et al., *Microstrip Antennas*, IEEE Press, New York, 1995, FIG. 31.

*Primary Examiner*—Don Wong
*Assistant Examiner*—Tan Ho
*Attorney, Agent, or Firm*—Koppel & Jacobs

[57] ABSTRACT

Antenna structures are shown that reduce fabrication and assembly time and cost, increase antenna reliability and enhance antenna performance. These structures include resilient flanges that are formed by a slotted ground plane and a rear ground plane which together surround a feed circuit. The ground planes are simply pressed together to engage the flanges in an overlapped and resiliently interlocked relationship. In other antenna structure, a capacitance probe forms a part of a coaxial transition. One end of the probe forms a capacitance face and the transition is configured to automatically space the capacitance face from a trunk end of the feed circuit. A second end of the probe is available for coupling signals to antenna-associated circuits (e.g., a downconverter). A pressed-together signal-transmission path through these circuits is formed with spring-loaded sockets. One socket receives the capacitance probe's second end and the other receives the center pin of an external coaxial connector. The sockets can form the access ports of the antenna-associated circuits or form part of a direct path to the antenna's exterior. In other structures, an antenna that includes a slotted ground plane and a feed circuit is converted to a slot-coupled patch array antenna with a polymer sheet that carries a plurality of metallic patches and a dielectric array spacer. These elements are simply pinned to the ground plane and feed circuit with a plurality of dielectric pins.

35 Claims, 4 Drawing Sheets

SLOT-COUPLED ARRAY ANTENNA STRUCTURES

CROSS REFERENCES TO RELATED APPLICATIONS

This application claims the benefit of U.S. provisional application Ser. No. 60/095,398 which was filed Aug. 5, 1998.

BACKGROUND OF THE INVENTION

1. Field of the Invention

The present invention relates generally to antennas and more particularly to slot-coupled array antennas.

2. Description of the Related Art

Slot-coupled array antenna concepts have been described by various authors (e.g., see Zurcher, Jean-Francois, et al., *Broadband Patch Antennas,* Artech House, Boston, 1995, pp. 45–61). These antenna concepts facilitate the realization of compact antennas that exhibit attractive performance in a number of antenna parameters (e.g., gain, bandwidth, side lobe reduction and cross polarization).

Slot-coupled array antennas, however, are formed with a number of antenna elements which have typically been assembled with costly time-consuming, volume-increasing and/or unreliable fabrication and assembly processes.

As a first example, solder connections have often been used between elements (e.g., feed structure, downconverter, transceiver and external coaxial connector) along a signal transmission path that carries electromagnetic signals to and from the antenna. In addition to being time intensive, the soldering process decreases antenna reliability and the heat of the process may damage or degrade antenna parts. The use of more costly parts has often been required to reduce the possibility of this heat damage.

In a second example, array antenna structures (e.g., upper and lower ground planes) have generally been joined together by adhesives or by the use of a large number of conventional fasteners (e.g., bolts and nuts). These assembly processes are time consuming, increase antenna volume and often form joints that add to the antenna's microwave dissipative and mismatch losses.

In yet another example, flexible transmission circuits have been employed to position external coaxial connectors at a desired antenna location. Flexible circuits typically reduce reliability, require additional space and are expensive.

SUMMARY OF THE INVENTION

The present invention is directed to slot-coupled antenna structures which reduce fabrication and assembly time and cost, increase antenna reliability and enhance antenna performance. These goals are achieved with antenna structures that include overlapped and resiliently interlocked flanges, a capacitively-coupled probe, pinned-on patch arrays and a pressed-together signal transmission path.

Resilient flanges are formed by a slotted ground plane and a rear ground plane which together surround a feed circuit. The ground planes are simply pressed together to engage the flanges in an overlapped and resiliently interlocked relationship. No other assembly structures (e.g., adhesives or screws) are required and it has been shown that the pressed-together ground planes enhance antenna performance (e.g., they effectively block rear radiation from the feed circuit and inhibit propagation of parallel-plate modes).

The probe forms a part of a coaxial transition. One end of the probe forms a capacitance face and the transition is configured (e.g., with a shoulder) to automatically space the capacitance face from a trunk end of the feed circuit. A second end of the probe is available for coupling signals to antenna-associated circuits (e.g., a downconverter) or directly to the antenna's exterior. The transition includes legs that are spaced from the trunk end to enhance signal flow to and from the feed circuit. An effective microwave signal-coupling structure is thereby quickly formed without time-consuming processes (e.g., soldering) or the need for bulky expensive coupling pieces (e.g., flexible transmission circuits).

In the invention, an antenna that includes a slotted ground plane and a feed circuit is converted to a slot-coupled patch array antenna with a polymer sheet that carries a plurality of metallic patches and a dielectric array spacer. These elements are simply pinned to the ground plane and feed circuit with a plurality of dielectric pins. The pins preferably form annular fins that engage the ground plane and feed circuit.

The pressed-together signal-transmission path is formed with spring-loaded sockets. One socket receives the capacitance probe's second end and the other receives the center pin of an external coaxial connector. The sockets can form the access ports of antenna-associated circuits (e.g., downconverters and transceivers) or form part of a direct path to the antenna's exterior.

In comparison to conventional antenna structures, those of the invention do not require soldering processes nor large numbers of attachment hardware (e.g., screws). Accordingly, these structures reduce assembly time and eliminate the risk of heat damage. Tests of these antenna structures demonstrate that these advantages over conventionally formed and assembled antennas are gained without any degradation of antenna performance.

The novel features of the invention are set forth with particularity in the appended claims. The invention will be best understood from the following description when read in conjunction with the accompanying drawings.

DETAILED DESCRIPTION OF THE PREFERRED EMBODIMENTS

Figure 1:
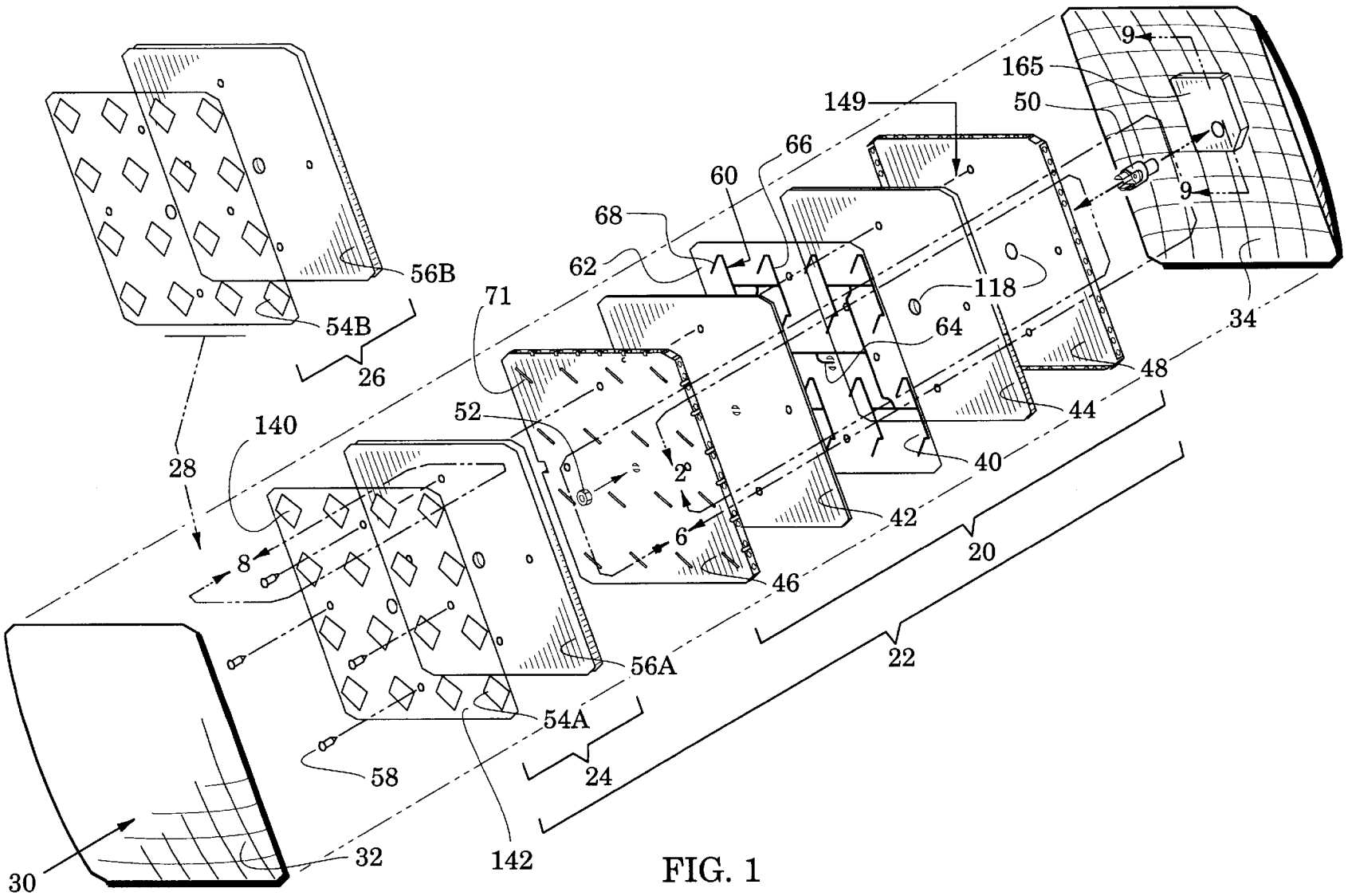
FIG. 1 is an exploded isometric view of slot-coupled array antenna structures of the present invention.

FIG. 1 is an exploded view of a slot-coupled array antenna 20. FIG. 1 also shows a second slot-coupled array antenna 22 that is formed by positioning a patch assembly 24 ahead of the first antenna 20. A third dual-band antenna is formed by positioning another patch assembly 26 in front of the patch assembly 24 as indicated by a positioning arrow 28. All of these antennas are preferably surrounded by an environmental radome 30 which is formed by front and back radome shells 32 and 34.

In detail, the antenna 20 includes a feed circuit 40 that is positioned between a first dielectric feed spacer 42 and a second dielectric feed spacer 44. These elements are surrounded by a slotted ground plane 46 and a rear ground plane 48. A transition 50 is inserted through the ground planes 46 and 48, the spacers 42 and 44 and the feed circuit 40 and is secured with conventional hardware such as a nut 52.

The patch assembly 24 includes a patch array 54A, a dielectric array spacer 56A and a plurality of dielectric pins 58 that secure the patch array and the array spacer to the antenna 20 and, thereby, form the antenna 22. The patch assembly 26 includes a patch array 54B and a dielectric array spacer 56B. The patch arrays 54A and 54B and the array spacers 56A and 56B are similar but are typically directed to reception and radiation of electromagnetic signals at different frequencies and, therefore, differ dimensionally. A dual-band antenna is formed by securing the patch assemblies 26 and 24 to the antenna 20 with the dielectric pins 58.

In comparison to conventional slot-coupled array antenna structures, those of FIG. 1 offer significant reductions in fabrication and assembly time and cost while also enhancing reliability and performance. Most elements of these antennas are simple dielectric sheets or stamped and formed metallic ground planes. Assembly requires no soldering nor the use of adhesives or flexible connecting structures and, instead, is accomplished with a single transition 50 and a few dielectric pins 58. The antennas are ready for service as soon as this simple assembly is complete, i.e., they require no tuning or alignment processes.

Figure 8:
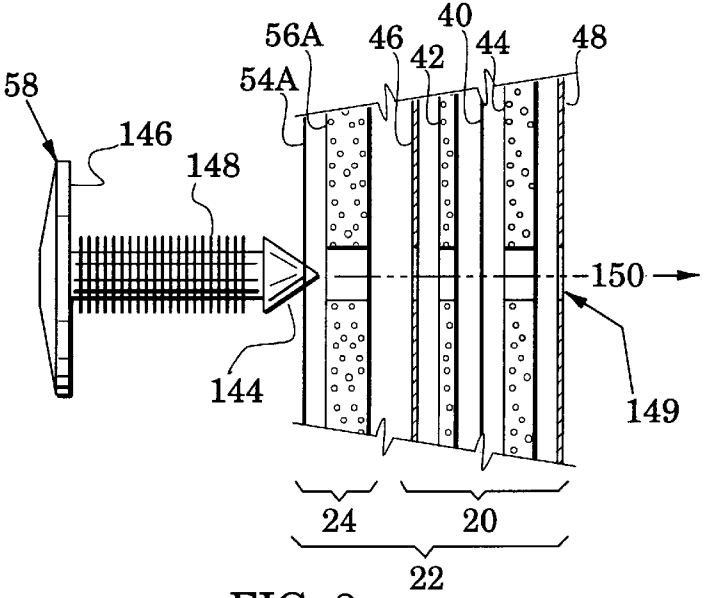
FIG. 8 is an enlarged sectional view of antenna structures within the broken line 8 of FIG. 1 that shows one of a set of fasteners and other structures that are associated with the fastener set.
Figure 11:
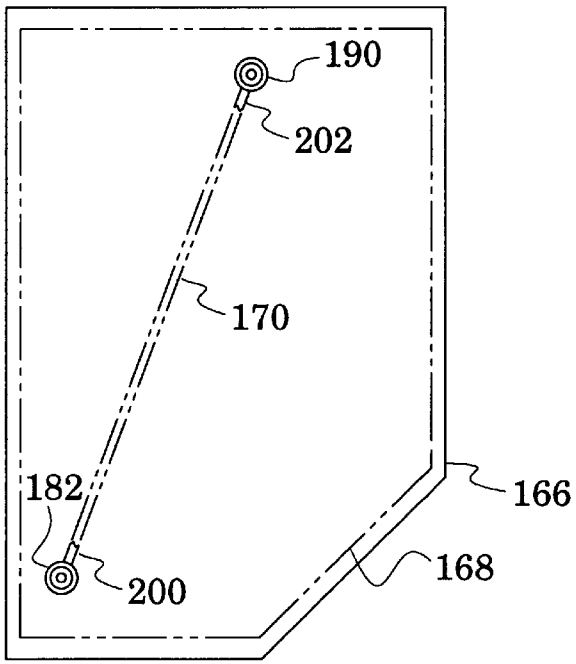
FIG. 11 is a view along the plane 11—11 of FIG. 9.
Figure 9:
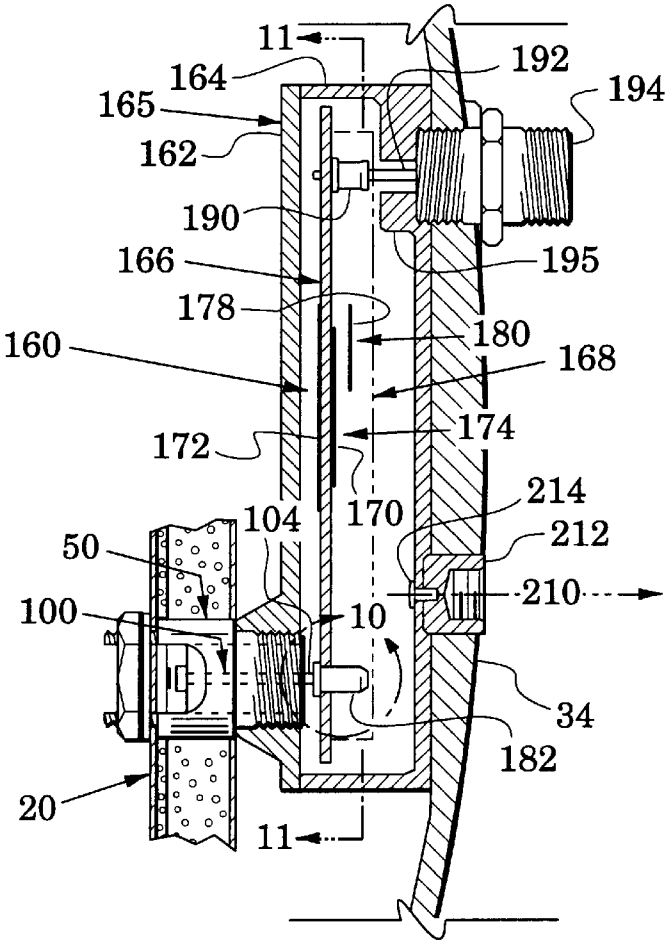
FIG. 9 is an enlarged sectional view along the plane 9—9 of FIG. 1 that illustrates a signal transmission path.
Figure 10:
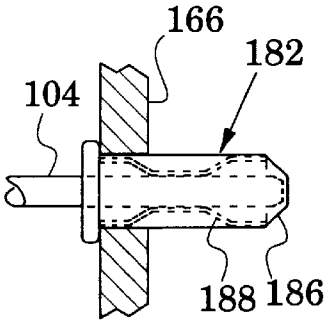
FIG. 10 is an enlarged view of structures within the broken line 10 of FIG. 9.

These advantages are realized with antenna structures that include overlapped and resiliently interlocked flanges (e.g., see FIGS. 2–5, a capacitively-coupled probe (e.g., see FIGS. 6 and 7), pinned-on patch arrays (e.g., see FIG. 8) and a pressed-together signal transmission path (e.g., see FIGS. 9–11).

In particular, FIGS. 2–5 further illustrate the first and second feed spacers 42 and 44, the feed circuit 40, the slotted ground plane 46 and the rear ground plane 48. The feed spacers are sheets of a suitable low-loss dielectric (e.g., polystyrene or polyethylene) and, as shown in FIG. 1, the feed circuit 40 is a metallic pattern 60 (e.g., copper or aluminum) carried on a thin polymer (e.g., polyimide or polyester) film or sheet 62. The pattern is preferably formed with conventional photolithographic processes. It has a trunk end 64 and branches from the trunk end (e.g., in a corporate pattern 66) to terminate in a plurality of stubs 68.

The slotted ground plane 46 and the rear ground plane 48 are each formed from thin (e.g., 0.3 mm) metallic (e.g., aluminum) sheets. As shown in FIGS. 2–5, the slotted ground plane has a central portion 70 that defines a plurality of slots 71 (also shown in FIG. 1) and that extends out to a perimeter which has a flange 72 that is bent at an angle (e.g., 90°) to the central portion 70. Because of the thinness of the ground plane, the flange 72 is easily moved from its bent angle but the resilient properties of the metallic sheet urge it back to its initial angle.

The rear ground plane 48 also has a central portion 74 and it also extends out to a perimeter which has a resilient flange 76 that is bent at an angle to the central portion 76 that is similar to the bent angle of the slotted ground plane 46.

In an exemplary assembly of these structures, the flexible feed circuit 40 is sandwiched between the first and second feed spacers 42 and 44 and these elements are dropped into the rear ground plane 48. The slotted ground plane 46 is then pressed against the rear ground plane to engage the resilient flanges 72 and 76 in the overlapped and resiliently interlocked relationship 80 of FIG. 5.

To enhance the interlocked relationship 80, one of the flanges preferably defines a plurality of first engagement members and the other of the flanges defines a plurality of second engagement members that each engage a respective one of the first engagement members. In the embodiment of FIGS. 2–5, these engagement members are apertures in the form of circular holes 82 and protuberances in the form of spherical bosses 84.

It has been found that engagement of the resilient flanges 72 and 76 is facilitated if the flange 72 is separated into a plurality of flange fingers 86 by a plurality of slits 88. The engagement is further facilitated by having the resilient flange 72 define an edge 90 that is canted from the angle of the flange. This canted edge receives the flange 76 of the rear ground plane 48 and guides it into the overlapped and resiliently interlocked relationship 80.

Figures 2, 3, 4, 5:
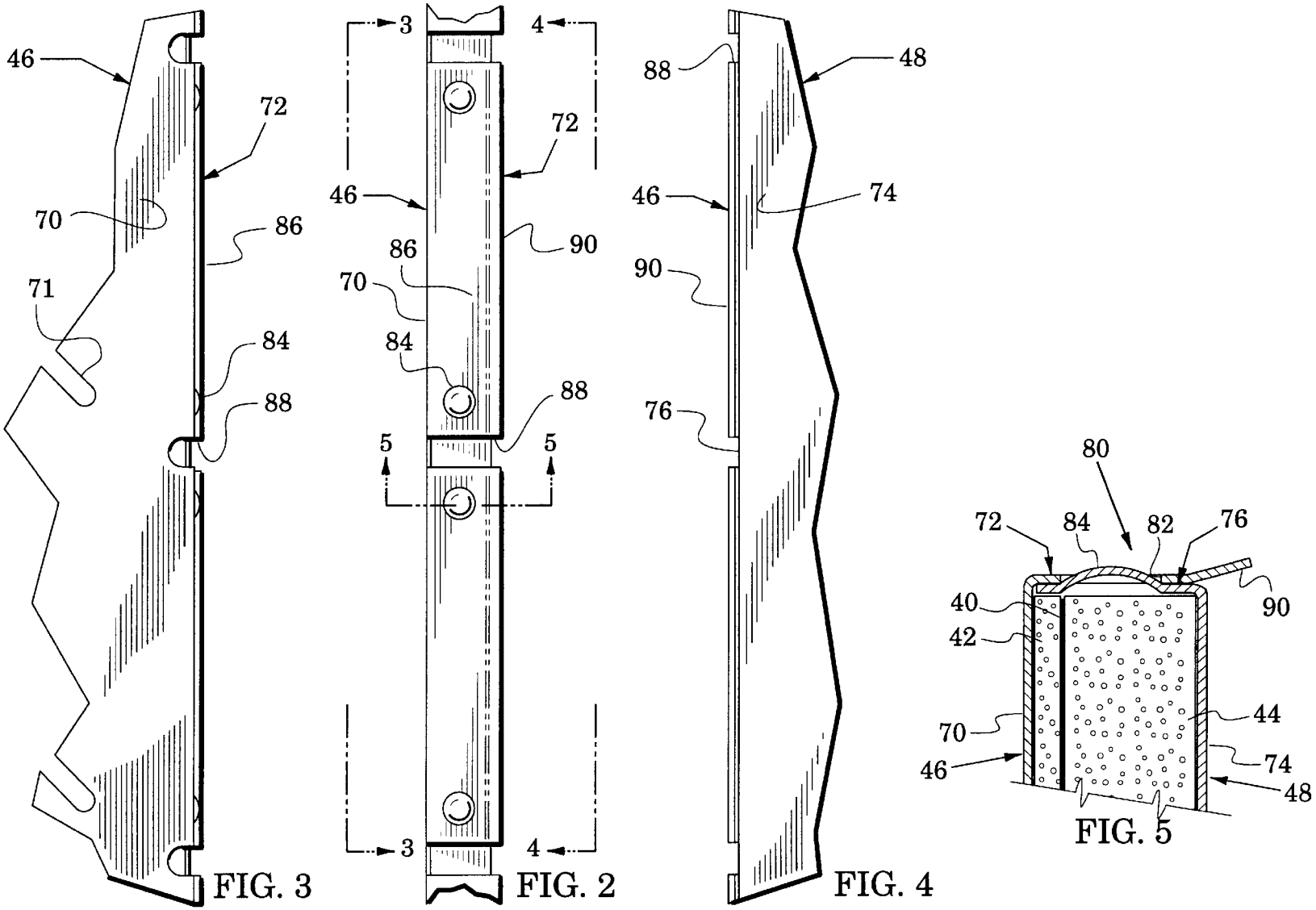
FIG. 2 is an enlarged view of antenna structures within the broken line 2 of FIG. 1 that shows these structures in an assembled state.
FIGS. 3 and 4 are views along the planes 3—3 and 4—4 respectively of FIG. 2.
FIG. 5 is an enlarged sectional view along the plane 5—5 of FIG. 2.

To insure that the first and second feed spacers 42 and 44, the feed circuit 40, the slotted ground plane 46 and the rear ground plane 48 are properly oriented, they can all be formed with structures (e.g., notches in their perimeters) that are aligned as the parts are assembled as in FIG. 5. In the proper orientation, each of the stubs (68 in FIG. 1) is positioned to receive and radiate electromagnetic energy through a respective one of the slots (71 in FIG. 1).

The resilience of the flanges 72 and 76 not only facilitates their insertion into the overlapped and resiliently interlocked relationship 80 of FIG. 5 but also enhance the electrical continuity of the slotted and rear ground planes 46 and 48. Accordingly, these structures enhance antenna performance by effectively blocking rear radiation from the feed circuit 40 and inhibiting propagation of parallel-plate modes.

Figure 6:
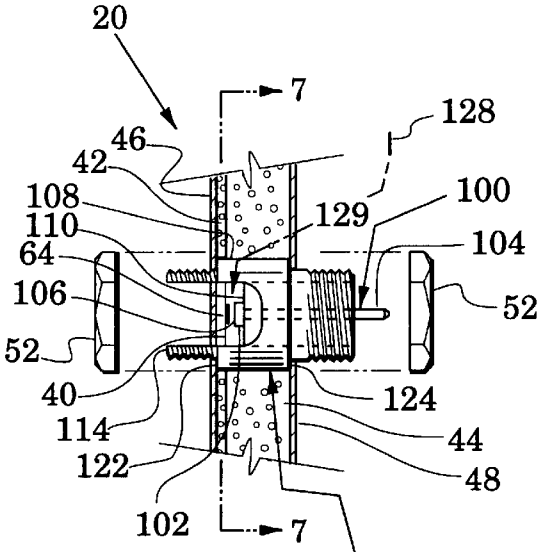
FIG. 6 is an enlarged sectional view of antenna structures within the broken line 6 of FIG. 1 that shows these structures in an assembled state.
Figure 7A:
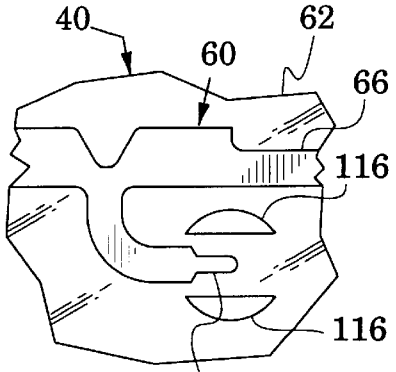
FIGS. 7A and 7B are views along the plane 7—7 of FIG. 6 that respectively show a feed circuit and the feed circuit received over the legs of a transition.
Figure 7B:
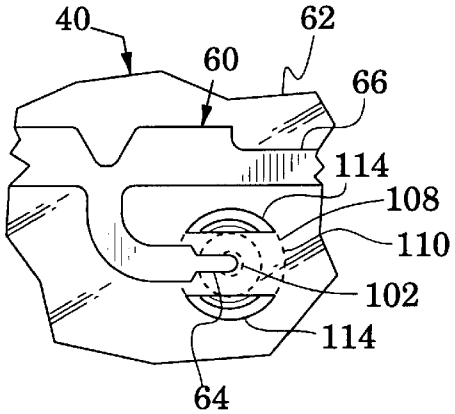

FIGS. 6, 7A and 7B illustrate other antenna structures of FIG. 1. In particular, they show a probe 100 which is capacitively spaced from the trunk end 64 of the feed circuit 40. The probe has a capacitance end 102 that defines a face that enhances the capacitance to the trunk end. The probe extends from the capacitance end to a second end 104. With a dielectric member 110, the probe 100 is coaxially positioned in a body 108 that is divided at one end into a pair of legs 114.

FIG. 7A shows the feed circuit 40 with its polymer sheet 62 and its metallic pattern 60 that forms a corporate pattern 66 and a trunk end 64. The sheet 62 also defines a pair of D-shaped apertures 116 that are oppositely spaced from the trunk end 64.

As shown in FIG. 7B, each of the apertures 116 receives a respective one of the legs 114. FIGS. 1 and 6 illustrate that each of the first feed spacer 42 and the slotted ground plane 46 form similar apertures which similarly receive the legs 114. In contrast, the second feed spacer 44 and the rear ground plane 48 form round apertures (118 in FIG. 1) that slip over the body 108.

The body 108 forms front and rear shoulders 122 and 124 which respectively abut the slotted ground plane 46 and the rear ground plane 48 to thereby establish the spacing between these ground planes. The first and second array spacers 42 and 44 also space the ground planes and, in addition, determine the spacing of the feed circuit 40 within the ground planes. Typically, forward coupling is enhanced when the spacing to the slotted ground plane 46 is less than the spacing to the rear ground plane 48. Accordingly, FIGS. 1 and 6 show the first array spacer 42 to be thinner than the second array spacer 44.

The shoulder 122 also sets the spacing between the capacitance face 106 and the trunk end 64. To further establish this spacing, a thin polymer tab 128 can be inserted between these elements as indicated by the insertion arrow 129 in FIG. 6. The tab 128 is preferably fabricated with an adhesive backing to maintain its position.

Together, the body 108, the dielectric member 110 and the probe 100 form the transition 50 (also shown in FIG. 1) that couples electromagnetic energy between the feed circuit 40 and external circuits without the need for soldering. The transition is preferably secured to the ground planes with connecting structures, e.g., press-fit structures or the nut-and-thread structures 52 shown in FIG. 6. FIG. 1 shows a different use of the rear shoulder 124 in which it and the rear ground plane 48 are spatially referenced to each other by having each of them abut a portion of the rear radome 34, e.g., an electronics compartment 165.

FIG. 8 illustrates other structures in the antennas of FIG. 1. As described above, the antenna 20 includes the slotted ground plane 46, the first and second feed spacers 42 and 44, the feed circuit 40, and the rear ground plane 48. As also described above, the patch assembly 24 of FIG. 1 includes the patch array 54A and the array spacer 56A. The patch array is formed in a manner similar to that of the feed circuit 40 of FIG. 7A. As shown in FIG. 1, it is accordingly a metallic pattern of patches 140 carried on a thin polymer film or sheet 142.

The dielectric pins 58 of FIG. 1 are shown in FIG. 8 to have a pointed end 144 and a head 146. Preferably, they also have retention structures such as a plurality of annular fins 148. Each of the elements of the antenna 20 and the patch assembly 24 define sets of holes (e.g., the hole set 149 of FIG. 1) and each of the pins 58 is inserted through a respective set as indicated by the insertion arrow 150 in FIG. 8. Thereafter, movement of the pins is inhibited by engagement of the fins 148 with the elements of the antenna and patch assembly.

Each of the patches 140 of FIG. 1 is positioned to be energized by a respective one of the slots 71. Addition of radiating patches generally enables the antenna 22 to generate a wider bandwidth than that of the antenna 20. As previously described, a dual-band antenna is formed by inserting the patch assembly 26 of FIG. 1 ahead of the patch assembly 24. They can both be pinned to the antenna 20 with a single group of pins 58.

Additional slot-coupled array antenna structures are shown in FIG. 9 which illustrates a pressed-together signal transmission path 160 for conducting signals to and from antennas of the invention. FIGS. 10 and 11 illustrate details of the transmission path. FIG. 1 illustrated the antenna 20 with its transition 50—these structures are again shown in FIG. 9 where one end of the transition is mounted in a cover 162 that is mated to a housing 164 to form an electronics compartment 165. As also shown in FIG. 1, the compartment 165 is carried by the rear radome shell 34.

Mounted within the compartment 165 is a circuit board 166 that carries an antenna-associated electronics circuit 168, e.g., a downconverter or a transceiver. Accordingly, the circuit board 166 is preferably configured with microwave signal paths. Exemplary microwave signal paths include a signal line 170 spaced over a ground plane 172 to form a microstrip signal path 174 and the signal line 170 spaced between ground planes 172 and 178 to form a stripline signal path 180.

A spring-loaded socket 182 is mounted in the circuit board 166 and receives the free end 104 of the probe 100 of the transition 50. As shown in FIG. 10, an exemplary socket has a shell 186 that contains an annular spring 188. Spring-loaded sockets may be readily obtained from various manufacturers (e.g., AMP, Incorporated, Harrisburg, Pa.).

Another spring-loaded socket 190 is mounted in another area of the circuit board 166 and it receives the center pin 192 of a coaxial external connector 194 that is carried in the rear radome shell 34. The socket 190 is similar to the socket 182 but is configured to be entered from a different side of the circuit board 166.

In an exemplary assembly process, the center pin 192 of the output connector 194 is pressed into the spring-loaded socket 190 and the probe end 104 is pressed into the spring-loaded socket 182. Thus, the signal transmission path 160 is formed through the transition 50, the socket 182, the antenna-associated circuit 168, the socket 190 and the external connector 194. In a feature of the invention, formation of the signal path 160 is quickly accomplished and does not require a soldering process. The housing 164 may include a boss 195 that cooperates with the center pin 192 to form a coaxial structure that enhances the signal transmission path.

FIG. 11 shows portions 200 and 202 of the signal line 174 as they respectively contact the spring-loaded sockets 182 and 190. The signal line portions 200 and 202 represent final paths of the antenna-associated circuit 168. As previously mentioned, exemplary antenna-associated circuits are downconverters and transceivers. Alternatively, antenna structures of the invention may be used without such antenna-associated circuits. In such cases, the signal transmission path 160 is simply completed with a direct microwave signal line that includes the signal line 170 that is indicated in broken lines in FIG. 11.

The structures of FIG. 9 also include a heat-conduction path 210 for conducting heat away from the antenna-associated circuit 168. The front and rear radome shells are preferably formed of impact-resistant polymers (e.g., acrylonitrile-butadiene-styrene (ABS)) which provide poor heat paths. Accordingly, bosses such as the boss 212 are carried in the radome shell 34. The boss 212 is coupled to the electronics housing 164 (e.g., by being molded therein or with conventional hardware 214) and both are formed of a heat-conducting metal (e.g., aluminum or copper). The boss 212 forms internal threads to facilitate mounting of the antenna to appropriate structures (e.g., houses or masts) which can dissipate the heat conducted through the boss 212.

Tests of prototype and production versions of antennas of the invention confirm that the advantages of the invention are realized without loss in antenna performance. Table 1 below shows performance parameters and test results for an exemplary S-band antenna prototype which included the overlapped and resiliently interlocked flanges of FIGS. 2–5, the capacitively-coupled probe of FIGS. 6 and 7, a pinned-on patch array as in FIG. 8 and the pressed-together signal transmission path of FIGS. 9–11.

| | |
|---|---|
| center frequency (MHz) | 2500 |
| gain (dB) | 17 |
| bandwidth (per cent) | 12 |
| side lobes (dB below main lobe) | 20 |
| cross polarization (dB) | 30 |
| return loss (dB) | 15 |

In Table 1, cross polarization represents the ratio between signals that exhibit the designed polarization and a polarization orthogonal to that designed polarization. Return loss represents reflected signals from the antenna probe (i.e., the probe 100 of FIG. 6).

The antennas associated with Table 1 included a single 4×4 patch array so that it was similar to the antenna 22 of FIG. 1. Antennas that eliminate a patch array and radiate directly from a slotted ground plane (e.g., the antenna 20 in FIG. 1) are less expensive because they require fewer parts and less assembly time but their bandwidths will typically be reduced from the bandwidth reported in Table 1.

Antennas that include a stacked patch array (e.g., the array assemblies 24 and 26 in FIG. 1) can radiate and receive in spaced-apart frequency bands to facilitate, for example, the use of a transceiver. Such antennas generally have bandwidths and return loss comparable to those of Table 1 but they are typically more expensive because of their additional parts and assembly time.

Antennas of the invention have been shown to reduce fabrication and assembly time, eliminate the possibility of heat damage and realize excellent antenna performance.

The preferred embodiments of the invention described herein are exemplary and numerous modifications, dimensional variations and rearrangements can be readily envisioned to achieve equivalent results, all of which are intended to be embraced within the scope of the appended claims.

We claim:

1. An antenna for reception and radiation of electromagnetic signals, comprising:

a first ground plane that forms at least one slot and transversely terminates in a first perimeter which defines a first resilient flange;

a feed circuit having a first side and a second side and terminating in at least one stub, said first side spaced from said first ground plane by a first space and said stub positioned to receive and radiate said electromagnetic signals through said slot;

a second ground plane that transversely terminates in a second perimeter which defines a second resilient flange, said second ground plane spaced from said second side by a second space with said first and second resilient flanges engaged in an overlapped and resiliently interlocked relationship;

resilience of said first and second resilient flanges facilitating their insertion into said relationship and enhancing electromagnetic continuity of said first and second ground planes.

2. The antenna of claim 1, further including:

a plurality of first engagement members formed by one of said first and second resilient flanges; and a plurality of second engagement members formed by the other of said first and second resilient flanges with each second engagement member configured to engage a respective one of said first engagement members to further enhance said resiliently interlocked relationship.

3. The antenna of claim 2, wherein:

said first engagement members are apertures; and said second engagement members are protuberances that extend into said apertures.

4. The antenna of claim 3, wherein said apertures are circular holes and said protuberances are spherical bosses.

5. The antenna of claim 1, wherein one of said first and second resilient flanges terminates in a beveled edge that facilitates insertion of said first and second resilient flanges into said overlapped and resiliently interlocked relationship.

6. The antenna of claim 1, wherein one of said first and second resilient flanges is divided into a plurality of resilient fingers to facilitate insertion of said first and second resilient flanges into said overlapped and resiliently interlocked relationship.

7. The antenna of claim 1, further including first and second dielectric spacers positioned to respectively occupy said first and second spaces.

8. The antenna of claim 7, wherein said first and second dielectric spacers comprise polyethylene.

9. The antenna of claim 8, wherein said probe is capacitively spaced from said trunk end.

10. The antenna of claim 8, further including a polymer film and wherein said feed circuit is a metallic pattern that is carried on said polymer film.

11. The antenna of claim 1;

wherein said feed circuit includes a corporate feed structure having a trunk end and at least one second end that is coupled to said stub; and further including a probe coupled to said trunk end;

said probe coupling said electromagnetic signals to and from said feed system.

12. An antenna for reception and radiation of electromagnetic signals, comprising:

a first ground plane that forms at least one slot;

a feed circuit having a trunk end and terminating in at least one stub end, said feed circuit having a first side and a second side with said first side spaced from said first ground plane by a first space and said stub positioned to receive and radiate said electromagnetic signals through said slot; and a probe having first and second ends with said first end defining a face that is capacitively spaced from said trunk end to facilitate passage of said electromagnetic signals between said feed circuit and said probe.

13. The antenna of claim 12, further including a socket which receives said probe second end.

14. An antenna for reception and radiation of electromagnetic signals, comprising:

a first ground plane that forms at least one slot;

a feed circuit having a trunk end and terminating in at least one stub end, said feed circuit having a first side and a second side with said first side spaced from said first ground plane by a first space and said stub positioned to receive and radiate said electromagnetic signals through said slot; and a probe having first and second ends with said first end capacitively spaced from said trunk end to facilitate passage of said electromagnetic signals between said feed circuit and said probe;

and further including a coaxial transition which includes:

a body that forms a first shoulder; and said probe which is coaxially arranged within said body;

and wherein said transition is arranged with said first shoulder abutting said first ground plane to thereby capacitively space said probe first end from said trunk end.

15. The antenna of claim 14, wherein said body forms first and second legs that are each spaced from a respective side of said trunk end to enhance flow of said electromagnetic signals between said feed circuit and said probe.

16. The antenna of claim 15, wherein said first and second legs are threaded and pass through said first ground plane and further including a nut coupled to said legs to secure them to said ground plane.

17. The antenna of claim 14, further including a dielectric member that positions said probe within said body.

18. The antenna of claim 14, further including a second ground plane spaced from said second side by a second space and wherein said body forms a second shoulder that abuts said second ground plane to further establish said first and second spaces.

19. The antenna of claim 18, wherein said first and second ground planes respectively form first and second resilient flanges that are engaged in an overlapped and resiliently interlocked relationship.

20. The antenna of claim 18, further including first and second dielectric spacers positioned to respectively occupy said first and second spaces.

21. An antenna, comprising:

a patch array that includes:

a) a polymer patch sheet; and b) a plurality of metallic patches that are carried on said polymer patch sheet;

a dielectric array spacer;

a feed circuit that includes:

a) a polymer feed sheet; and b) a metallic pattern that is carried on said polymer feed sheet, said pattern having a first side and a second side and terminating in a plurality of stubs;

a first ground plane that forms a plurality of slots, one side of said first ground plane spaced from said patch array by said array spacer and another side of said first ground plane spaced from said first side by a first space with each of said slots positioned between a respective one of said patches and a respective one of said stubs;

a set of holes formed by said patch sheet, said array spacer, said feed sheet and said ground plane; and a set of dielectric pins inserted into said set of holes to secure and align said patch sheet, said array spacer, said feed sheet and said ground plane, wherein each of said dielectric pins has a pointed end to facilitate its insertion and a retention structure to inhibit its movement.

22. The antenna of claim 21, wherein said retention structure includes a plurality of annular fins.

23. The antenna of claim 21, further including a second ground plane spaced from said second side by a second space and wherein said set of holes includes holes through said second ground plane.

24. The antenna of claim 23, further including:

a first dielectric feed-circuit spacer that occupies said first space; and a second dielectric feed-circuit spacer positioned that occupies said second space;

and wherein said set of holes includes holes through said first and second feed-circuit spacers.

25. An antenna, comprising:

a patch array that includes:

a) a polymer patch sheet; and b) a plurality of metallic patches that are carried on said polymer patch sheet;

a dielectric array spacer;

a feed circuit that includes:

a) a polymer feed sheet; and b) a metallic pattern that is carried on said polymer feed sheet, said pattern having a first side and a second side and terminating in a plurality of stubs;

a first ground plane that forms a plurality of slots, one side of said first ground plane spaced from said patch array by said array spacer and another side of said first ground plane spaced from said first side by a first space with each of said slots positioned between a respective one of said patches and a respective one of said stubs;

a set of holes formed by said patch sheet and said array spacer and at least one of said first ground plane and said feed sheet;

a set of dielectric pins inserted into said set of holes to secure and align said patch sheet, said array spacer, said feed sheet and said ground plane; and a second ground plane spaced from said second side by a second space and wherein said set of holes includes holes through said second ground plane;

wherein said first and second ground planes respectively form first and second resilient flanges that are engaged in an overlapped and resiliently interlocked relationship.

26. An antenna for reception and radiation of electromagnetic signals, comprising:

a first ground plane that forms at least one slot;

a feed circuit having a trunk end and terminating in at least one stub end, said feed circuit having a first side and a second side with said first side spaced from said first ground plane by a first space and said stub positioned to receive and radiate said electromagnetic signals through said slot;

an environmental radome that surrounds said first ground plane and said feed circuit; and a signal transmission path for conducting said electromagnetic signals to and from said feed circuit, said transmission path including:

a) at least one conductive path;

b) first and second sockets coupled to said conductive path;

c) a probe having first and second ends with said first end capacitively spaced from said trunk end and said second end inserted in said first socket; and d) a coaxial connector mounted in said radome, said connector having a center pin inserted in said second socket.

27. The antenna of claim 26, further including first and second annular resilient members respectively carried in said first and second sockets to enhance electromagnetic continuity through said probe, said pin and said conductive path.

28. The antenna of claim 26, wherein said radome comprises a polymer and further including a heat conduction path formed by:

a metallic electronics compartment positioned within said radome: and at least one metallic boss coupled to said compartment and extending through said radome.

29. The antenna of claim 28, wherein said conductive path and said first and second sockets are positioned within said electronics compartment.

30. The antenna of claim 28, wherein said conductive path is a microstrip path.

31. The antenna of claim 28, further including a transceiver carried in said compartment wherein said transceiver forms said conductive path.

32. The antenna of claim 28, further including a down-converter carried in said compartment wherein said down-converter forms said conductive path.

33. The antenna of claim 26, wherein said probe first end defines a face to enhance capacitance between said first end and said trunk end.

34. The antenna of claim 26, further including a second ground plane spaced from said second side by a second space.

35. The antenna of claim 34, wherein said first and second ground planes respectively form first and second resilient flanges that are engaged in an overlapped and resiliently interlocked relationship.

* * * * *